US007921963B2

(12) United States Patent
Ishizuka et al.

(10) Patent No.: US 7,921,963 B2
(45) Date of Patent: Apr. 12, 2011

(54) INTERNAL COMBUSTION ENGINE EQUIPPED WITH INTAKE SILENCER

(75) Inventors: Kunihiko Ishizuka, Wako (JP); Kazuhiro Ishizaka, Wako (JP)

(73) Assignee: Honda Motor Co., Ltd., Tokyo (JP)

( * ) Notice: Subject to any disclaimer, the term of this patent is extended or adjusted under 35 U.S.C. 154(b) by 97 days.

(21) Appl. No.: 11/991,219

(22) PCT Filed: Mar. 9, 2007

(86) PCT No.: PCT/JP2007/054666

§ 371 (c)(1),
(2), (4) Date: Oct. 31, 2008

(87) PCT Pub. No.: WO2007/113987

PCT Pub. Date: Oct. 11, 2007

(65) Prior Publication Data

US 2009/0078497 A1 Mar. 26, 2009

(30) Foreign Application Priority Data

Mar. 31, 2006 (JP) ..... 2006-099096
Mar. 31, 2006 (JP) ..... 2006-099097

(51) Int. Cl.
*F02M 35/00* (2006.01)

(52) U.S. Cl. ..... 181/229; 181/212; 123/184.53; 123/184.54; 123/184.55; 123/184.56; 123/184.57

(58) Field of Classification Search ..... 181/212, 181/229; 123/184.53, 184.54, 184.55, 184.56, 123/184.57

See application file for complete search history.

(56) References Cited

U.S. PATENT DOCUMENTS

| | | | | |
|---|---|---|---|---|
| 4,420,063 | A * | 12/1983 | Bohlmann et al. | 181/229 |
| 5,647,314 | A | 7/1997 | Matsumura et al. | |
| 5,826,553 | A * | 10/1998 | Nakayama et al. | 123/184.42 |
| 5,929,397 | A * | 7/1999 | Satoh et al. | 181/229 |
| 6,026,775 | A * | 2/2000 | Yamane | 123/184.53 |
| 7,198,017 | B2 * | 4/2007 | Vogt et al. | 123/184.57 |
| 2009/0236172 | A1 * | 9/2009 | Ross et al. | 181/204 |

FOREIGN PATENT DOCUMENTS

JP 02-049963 2/1990

(Continued)

*Primary Examiner* — Forrest M Phillips
(74) *Attorney, Agent, or Firm* — Carrier Blackman & Associates, P.C.; Joseph P. Carrier; William D. Blackman

(57) ABSTRACT

An intake system for an internal combustion engine has an intake silencer 30 provided with an expansion chamber 33, and a connecting pipe 40 having an inlet 46 through which air from the expansion chamber flows, and an outlet 47 through which air flows toward combustion chambers. The connecting pipe 40 is made of an elastic material having rubber elasticity, and has a connecting part 41 connected to the intake silencer 30, an inner tubular part 42 extending from the connecting part 41 into the expansion chamber 33 and having the inlet 46, and an outer tubular part 43 connecting to a throttle device 50. The wall 42*w* of the inner tubular part 42 is provided with a communication opening 44 for connecting the expansion chamber 33 and the air passage 45 to make the expansion chamber 33 serve also as a resonance chamber. The outer tubular part 43 of the connecting pipe 40 is shorter than the inner tubular part 42 of the same. The intake silencer is compact and has a combined effect of expansion silencing and resonance silencing.

20 Claims, 7 Drawing Sheets

FOREIGN PATENT DOCUMENTS

| | | | |
|---|---|---|---|
| JP | 08-158965 | A | 6/1996 |
| JP | 10-184469 | | 7/1998 |
| JP | 2000-145594 | | 5/2000 |
| JP | 2001-165012 | | 6/2001 |
| JP | 2003-193918 | A | 7/2003 |
| JP | 2005-120915 | A | 5/2005 |

* cited by examiner

INTERNAL COMBUSTION ENGINE EQUIPPED WITH INTAKE SILENCER

TECHNICAL FIELD

The present invention relates to an internal combustion engine equipped with an intake silencer having an expansion chamber. The internal combustion engine is applied to, for example, an outboard motor.

BACKGROUND ART

Intake systems disclosed in, for example, JP 2001-165012 A and JP 2000-145594 A, for an internal combustion engine, are equipped with an intake silencer forming an expansion chamber to reduce intake noise. An intake system, for an internal combustion engine, disclosed in, for example, JP 2-49963 A is provided with an intake air silencing device provided with a resonance chamber in addition to an intake silencer.

When intake noise in a specific frequency range cannot be sufficiently effectively damped only by the intake silencer forming an expansion chamber, namely, expansion silencer, an intake silencer forming a resonance chamber, namely, resonance silencer, is used in combination with the expansion silencer. The intake silencer is large if the expansion silencer and the resonance silencer are installed separately. Therefore, it is difficult to compactly incorporate such a large intake silencer into a machine formed in extremely compact construction, such as an outboard motor.

An internal combustion engine for an outboard motor is disclosed in, for example, JP 10-184469 A. This known internal combustion engine has an intake silencer forming an expansion chamber and connected to a throttle device by a short, flexible connecting pipe. A known internal combustion engine disclosed in, for example, JP 2000-145594 A has an intake silencer connected to a throttle device connected to a cylinder head by an intake pipe extending in the intake silencer.

When an intake silencer and a throttle device are connected by an elastic connecting pipe having rubber elasticity, vibrations of an engine body are not readily transmitted to the intake silencer and, consequently, noise resulting from the vibration of the intake silencer is reduced. On the other hand, since the intake pipe connecting the intake silencer and the throttle device extends in the intake silencer, engine output can be increased by an intake inertia effect, and intake noise in a specific frequency range can be reduced by adjusting the length of part of the intake pipe extending in the intake silencer without entailing increase in the size of the intake system which will result from increase in the interval between the intake silencer and the throttle device. However, the intake silencer and the throttle device cannot be connected by a long elastic connecting pipe having rubber elasticity because the connecting pipe is flexible.

DISCLOSURE OF THE INVENTION

Underlying Problem to be Solved by the Invention

The present invention has been made in view of the foregoing problems and it is therefore a principal object of the present invention to provide a compact intake silencer having, in combination, an expansion-silencing effect and a resonance-silencing effect. Another object of the present invention is to provide an intake system capable of reducing intake noise in various frequency ranges, to enhance the silencing effect of an expansion chamber by a resonance effect, and to provide an intake silencer having a simple shape and a high silencing effect. A further object of the present invention is to reduce noise caused by the vibration of an intake silencer, to arrange an intake silencer and a throttle device in an compact arrangement, to reduce intake noise and to increase the output of an engine by adjusting the length of an intake passage, to improve the intake efficiency of a compact intake silencer, and to optimize an intake noise reducing effect by properly curving a connecting pipe in an intake silencer.

Means for Solving the Underlying Problem

The present invention provides an internal combustion engine provided with an intake system including an intake silencer provided with an expansion chamber having an intake air inlet for conducting air into the expansion chamber; and an air passage structure forming an air passage and having an air inlet through which air from the expansion chamber flows, and an air outlet through which air from the air passage structure flows out toward combustion chambers; wherein the air passage structure has a passage wall isolating the air passage from the expansion chamber in the intake silencer, and the passage wall is provided with a communication opening by means of which the expansion chamber communicates with the air passage to function as a resonance chamber.

Typically, the passage structure is a connecting pipe having a connecting part connected to the intake silencer, and an inner tubular part extending from the connecting part into the expansion chamber and provided with the air inlet; and the passage wall is the wall of the inner tubular part of the connecting pipe. Preferably, the inner tubular part has a curved part curving from the connecting part toward a central region of the expansion chamber.

The curved part may be curved through an angle of about 90° relative to the connecting part.

The passage structure may have an outer tubular part extending to the outside of the expansion chamber from the connecting part and connecting to a throttle device having a throttle body forming an intake passage in which a throttle valve is placed. Preferably, the passage structure is made of an elastic material having rubber elasticity. Desirably, the outer tubular part is shorter than the inner tubular part.

Preferably, the air inlet of the passage structure, and the intake air inlet are arranged in a direction in which the curved part of the inner tubular part of the connecting pipe is curved.

The connecting part may be provided with positioning means for determining a circumferential position of the connecting part relative to the intake silencer to determine a direction in which the inner tubular part is curved relative to the intake silencer.

EFFECT OF THE INVENTION

According to the present invention, the expansion chamber can be used as a resonance chamber by the effect of the communication opening formed in the passage wall isolating the air passage from the expansion chamber. Therefore, an expansion chamber and a resonance chamber do not need to be formed separately. The synergistic effect of an expansion silencing effect and a resonance silencing effect provides a high intake noise silencing effect.

The passage structure may serve as a connecting pipe having the connecting part connected to the intake silencer, and the inner tubular part extending from the connecting part into the expansion chamber and having the air inlet; the passage wall may be the wall of the inner tubular part; and the inner tubular part may have the curved part curved so as to extend form the connecting part toward the central part of the expansion chamber. Since the inner tubular part is curved in the expansion chamber, the inner tubular part can be disposed in an increase length in the expansion chamber, and the intake silencer can be formed in a compact structure. Thus the inner tubular part can be formed in a proper length to silence intake noises of frequencies in various frequency ranges.

The communication opening can be disposed near the central part of the expansion chamber by curving the inner tubular pipe. Therefore, the expansion chamber can be effectively used as the resonance chamber regardless of the position of the air passage in the connecting part connected to the intake air outlet of the intake silencer with respect to the intake silencer.

The curved part may be curved through about 90° relative the connecting part. Therefore, the intake noise impinges on the curved part curved through about 90°, and then enters the expansion chamber. Thus the frequency of changes of the flowing direction of the pulsating intake air in the intake silencer increases and, consequently, the intake noise emitted by the intake air inlet can be reduced without forming the intake silencer in a complicated structure.

The passage structure has the outer tubular part of the connecting pipe extending to the outside of the expansion chamber from the connecting part, and the outer tubular part may be connected to the throttle device having the throttle body forming the intake passage in which the throttle valve is placed. Preferably, the passage structure is made of an elastic material having rubber elasticity. Desirably, the outer tubular part of the connecting pipe is shorter than the inner tubular part of the connecting pipe.

The passage structure made of an elastic material having rubber elasticity suppresses the transmission of vibrations of the engine body through the throttle device to the intake silencer and, consequently, the vibration of the intake silencer can be reduced. Since the outer tubular part of the connecting pipe may be shorter than the inner tubular part of the connecting pipe, the intake silencer and the throttle device can be disposed close to each other, and the space between the intake silencer and the throttle device can be narrowed. The length of the intake passage can be increased by using the long inner tubular part extending in the intake silencer to form the intake passage in an increased length. Thus the enlargement of the intake system can be avoided.

When the inner tubular part is curved, and the air inlet of the passage structure and the intake air inlet are arranged in the direction in which the curved part of the inner tubular pipe is curved, the length of the intake passage can be increased without affecting the compact construction of the intake silencer. Since the air inlet of the passage structure and the intake air inlet are arranged in the direction in which the curved part of the inner tubular part is curved, air can flow in a comparatively simple flow from the air inlet to the intake opening, and the intake silencer exerts a low passage resistance on the flow of air.

The connecting part may be provided with the positioning parts for determining the circumferential position of the connecting part relative to the intake silencer to determine a direction in which the inner tubular part of the connecting pipe is curved relative to the intake silencer. Thus any fastening member for fastening the connecting pipe to the intake silencer, such as a clamp, is not necessary. An optimum direction in which the inner tubular part of the connecting pipe is to be curved with respect to the intake silencer in view of intake noise suppression can be easily determined by using the passage wall.

REFERENCE SIGNS

1 . . . Mount case, 2 . . . Oil case, 3 . . . Extension case, 4 . . . Gear case, 5 . . . Under cover, 6 . . . Engine cover, 7 . . . Engine compartment, 8 . . . Flywheel, 9 . . . Drive shaft, 10 . . . Reversing mechanism, 11 . . . Propeller shaft, 12 . . . Propeller, 13 . . . Shift rod, 14 . . . Swivel shaft, 15 . . . Swivel case, 16 . . . Tilt shaft, 17 . . . Bracket, 18 . . . Hull, 20 . . . Cylinder block, 21 . . . Crankcase, 22 . . . Cylinder head, 23 . . . Head cover, 24 . . . Piston, 25 . . . Connecting rod, 26 . . . Crankshaft, 27 . . . Combustion chamber, 28 . . . Transmission mechanism, 29 . . . Camshaft, 30 . . . Intake silencer, 31, 32 . . . Case, 33 . . . Expansion chamber, 34 . . . Intake air inlet, 35 . . . Connecting part, 36, 37 . . . Recessed parts, 38 . . . Protrusion, 40 . . . Connecting pipe, 41 . . . Connecting part, 42 . . . Inner tubular part, 43 . . . Outer tubular part, 44 . . . Communication opening, 45 . . . Air passage, 46 . . . Inlet, 47 . . . Outlet, 49 . . . Clamp, 50 . . . Throttle device, 51 . . . Throttle body, 52 . . . Throttle valve, 53 . . . Throttle operating mechanism, 54 . . . Throttle position sensor, 55 . . . Intake passage,
60 . . . Intake manifold, S . . . Outboard motor, E . . . . Internal combustion engine, K . . . Intake system, H1, H2 . . . Passage, F . . . Flame arrester, L, La, Lb, Lc, Lt . . . Center lines.

BEST MODE FOR CARRYING OUT THE INVENTION

The present invention will be described with reference to the accompanying drawings.

Figure 1:
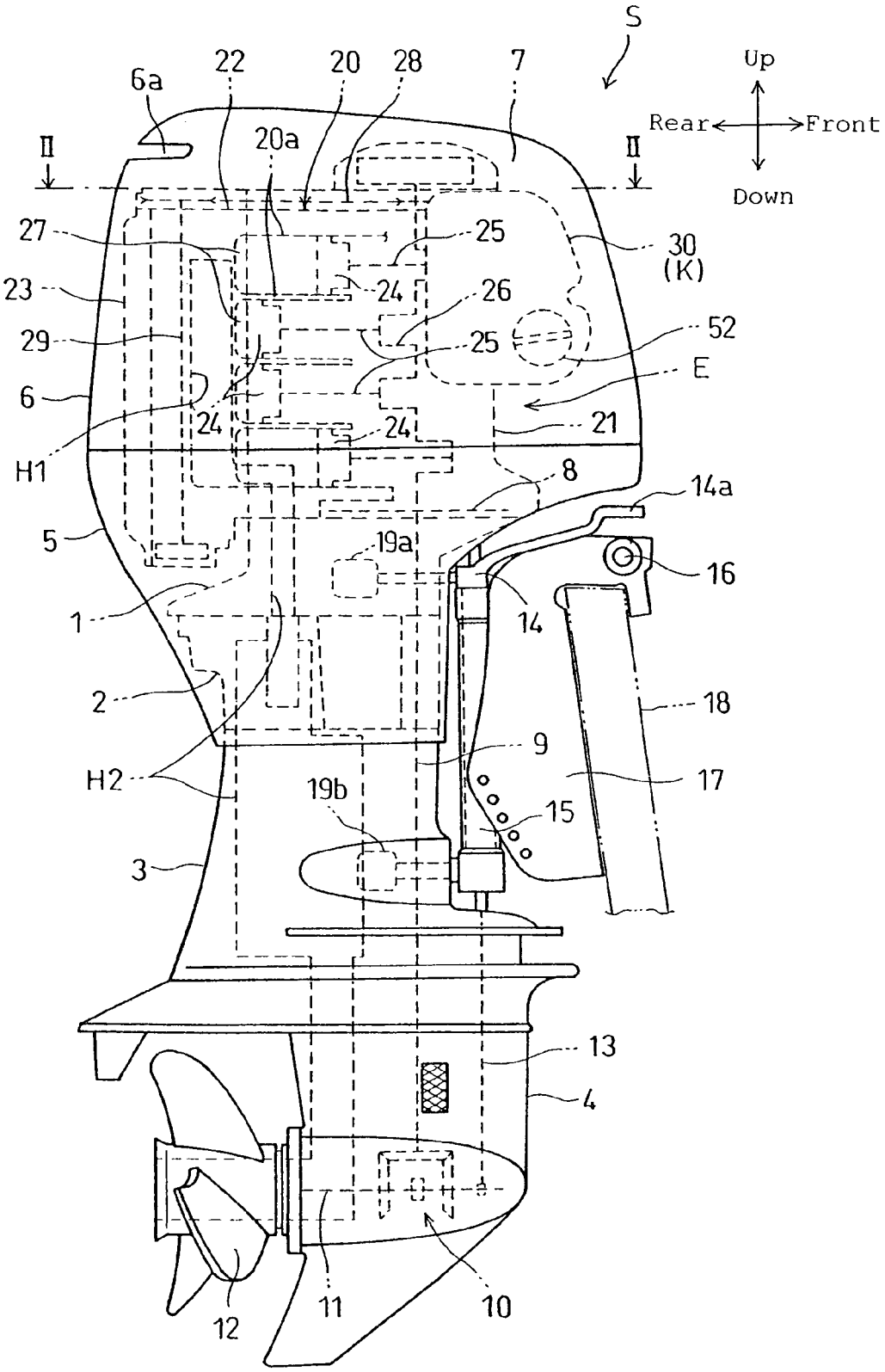
FIG. 1 is a right-hand side elevation of an outboard motor provided with an internal combustion engine in a preferred embodiment of the present invention.

Referring to FIG. 1, an internal combustion engine in a preferred embodiment of the present invention is incorporated into an outboard motor S, namely, a marine propulsion machine. The outboard motor S includes an internal combustion engine E provided with a crankshaft 26 having a vertical center axis, a transmission mechanism for transmitting the power of the internal combustion engine E to a propeller 12, a mount case 1 supporting the internal combustion engine E thereon, an oil case 2 joined to the lower end of the mount case 1, an extension case 3 joined to the lower end of the oil case 2, a gear case 4 joined to the lower end of the extension case 3, an under cover 5 covering a lower part of the internal combustion engine E, the mount case 1, the oil case 2 and an upper part of the extension case 3, and an engine cover 6 joined to the upper end of the under cover 5 so as to cover the internal combustion engine E from above the same.

In the following description, the terms up, down, front, rear; right, left and such are used to indicate directions, positions and such with respect to the position of the outboard motor S mounted on a hull 18.

The transmission mechanism includes a drive shaft 9 connected to the lower end of the crankshaft 26 so as to rotate together with a flywheel 8, a reversing mechanism 10 having a bevel gear mechanism and contained in the gear case 4, and a propeller shaft 11 holding the propeller 12 thereon. The drive shaft 9 extends vertically through the mount case 1 and the extension case 3 into the gear case 4. The lower end part of the drive shaft 9 is interlocked with the propeller shaft 11 by the reversing mechanism 10. The reversing mechanism 10 is set in a forward position for moving the hull 18 forward or a rearward position for moving the hull 18 rearward by turning a shift rod 13 extended through a swivel shaft 14. The power of the internal combustion engine E is transmitted through the crankshaft 26, the drive shaft 9, the reversing mechanism 10 and the propeller shaft 11 to the propeller 12 to rotate the propeller 12.

A mounting device included in the outboard motor S includes the swivel shaft 14 provided with an operating lever 14*a*, a swivel case 15 rotatably supporting the swivel shaft 14, and a bracket 17 holding a tilt shaft 16 supporting the swivel shaft 15 so as to be tiltable and fixed to the transom of the hull 18. The swivel shaft 14 has an upper end part fixedly held on the mount case 1 by a mount rubber 19*a*, and a lower end part fixedly held on the extension case 3 by a mount rubber 19*b*. The outboard motor S held on the hull 18 by the mounting device can be turned on the tilt shaft 16 in a vertical plane and can be turned to the right and to the left on the swivel shaft 14 in a horizontal plane.

Figure 2:
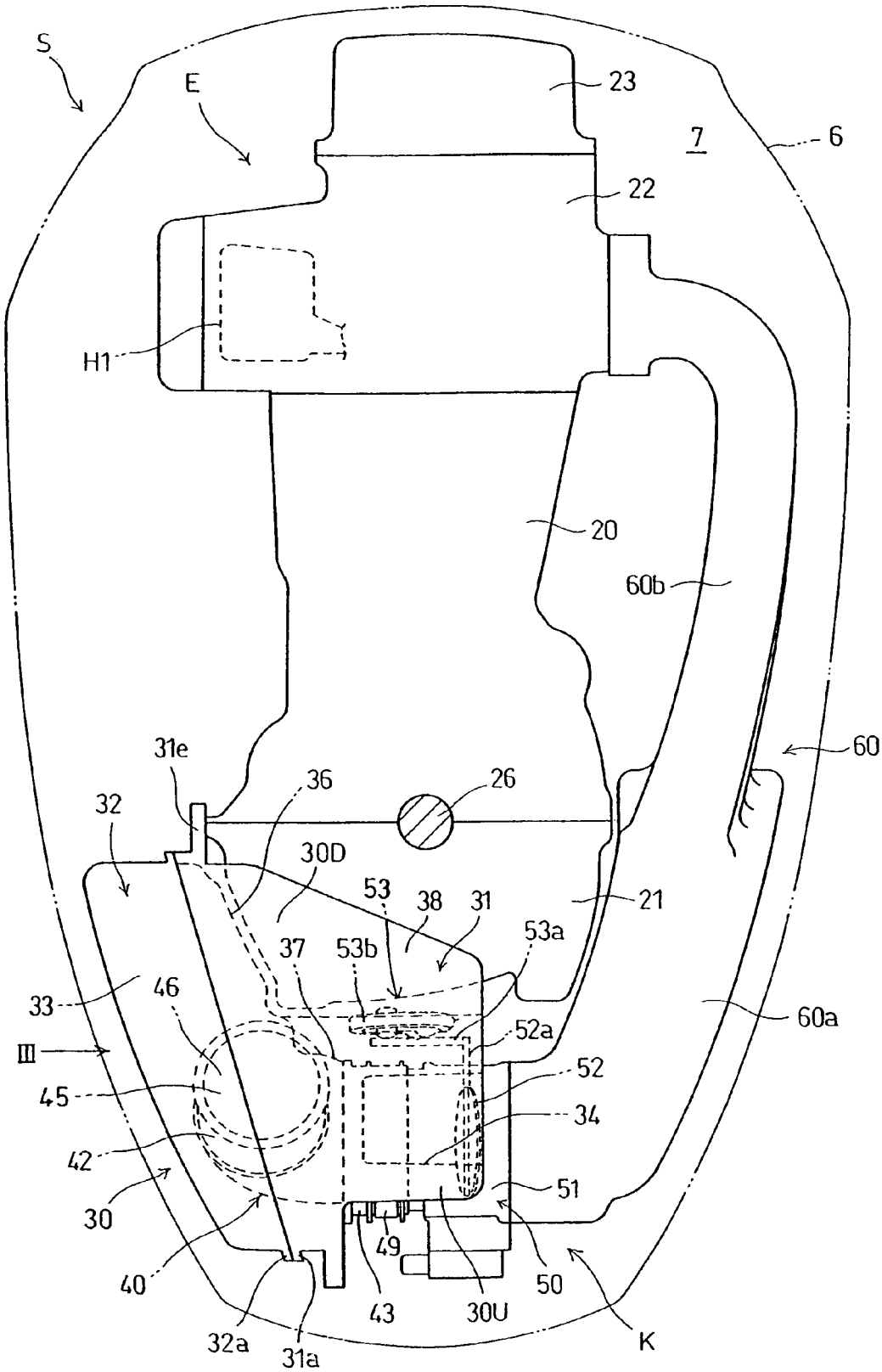
FIG. 2 is a sectional view taken on the line II-II in FIG. 1.

Referring also to FIG. 2, the internal combustion engine E, namely, an in-line four-cylinder four-stroke internal combustion engine, has a cylinder block 20 integrally provided with four cylinders 20*a*, a crankcase 21 joined to the front end of the cylinder block 20, a cylinder head 22 joined to the rear end of the cylinder block 20, and a head cover 23 joined to the rear end of the cylinder head 22.

Pistons 24 axially slidably fitted in the cylinders 20*a* are connected to the crankshaft 26 by connecting rods 25, respectively. The cylinder head 22 is provided with combustion chambers 27 respectively corresponding to the pistons 24, and intake and exhaust ports respectively opening into the combustion chambers 27. Intake valves and exhaust valves are driven by an overhead camshaft type valve train including a camshaft 29 driven for rotation through a transmission mechanism 28 by the crankshaft 26 to open and close the intake and the exhaust ports, respectively.

The internal combustion engine E is installed in an engine compartment 7 defined by the under cover 5 and the engine cover 6. The internal combustion engine E has an intake system K for carrying combustion air into the combustion chambers 27, and an exhaust system provided with passages H1 and H2 (FIG. 1) for carrying a combustion gas generated by the combustion of an air-fuel mixture in the combustion chambers 27 to the outside of the outboard motor S. Intake air flowing through an intake passage formed in the intake system K is mixed with fuel discharged from each of fuel injection valves, namely, air-fuel mixture producing means, attached to the cylinder head 22. The air-fuel mixture is sucked through the intake port into the combustion chamber 27. The air-fuel mixture sucked into the combustion chamber 27 burns when ignited by a spark plug. The piston 24 is driven for reciprocation by the pressure of the combustion gas to drive the crankshaft 26 for rotation through the connecting rod 25. The combustion gas thus used for driving the piston 24 is discharged as an exhaust gas from the combustion chamber 27 through the exhaust port into the exhaust passage H1 formed in the cylinder head 22 and the cylinder block 21. Then, the exhaust gas flows through the exhaust passage H2 formed in the mount case 1, the extension case 3, the gear case 4 and the boss of the propeller 12, and flows to the outside from the outboard motor S.

The intake system K disposed in the engine room 7 takes in a part of the atmospheric air that has flowed through an air inlet 6*a* (FIG. 1) formed in the engine cover 6 into the engine compartment 7 as combustion air. As shown in FIG. 2, the intake system K has an intake silencer 30 having an expansion chamber 33, namely, a silencing chamber into which air that has flowed through an intake air inlet 34 flows, a connecting pipe 40, namely, a passage structure defining an air passage 45 and an inlet 46 through which air flows from the expansion chamber 33 into the air passage 45, a throttle device 50 connected to the intake silencer 30 by the connecting pipe 40, and an intake manifold 60 having an upstream end connected to the throttle device 50, and a downstream end connected to the cylinder head 22 in which the inlets of the intake ports open. The intake manifold 60 has a main pipe 60*a* connected to the throttle device 50, and four branch pipes 60*b* branching from the main pipe 60*a* and respectively connected to the intake ports.

The intake silencer 30 will be described with reference to FIGS. 2 to 7. As shown in FIG. 2, the intake silencer 30 is provided with the intake air inlet 34 through which the intake system K takes in the atmospheric air. The intake silencer 30 has a body formed by joining together a first case 31 and a second case 32, namely, right and left cases. The cases 31 and 32 have flanges 31*a* and 32*a*, and joining parts 31*b* and 32*b* (FIG. 4) having the shape of a hollow column, respectively. The joining parts 31*b* and 32*b* are formed in substantially central parts of the cases 31 and 32, respectively. The joining parts 31*b* and 32*b* are welded together. The cases 31 and 32 of the intake silencer 30 having outer walls W1 and W2 (FIG. 6) defining the expansion chamber 33 are thin members of a synthetic resin. The outer walls W1 and W2 are reinforced by intersecting reinforcing ribs 31*c* and 32*c* (FIG. 4) formed on the inside surfaces thereof, respectively. A plurality of mounting parts 31*e* (FIGS. 3, 4 and 7) formed in the case 31 are fastened to the crankcase 21 by fastening means, such as bolts, to mount the intake silencer 30 on the crankcase 21.

Figure 6:
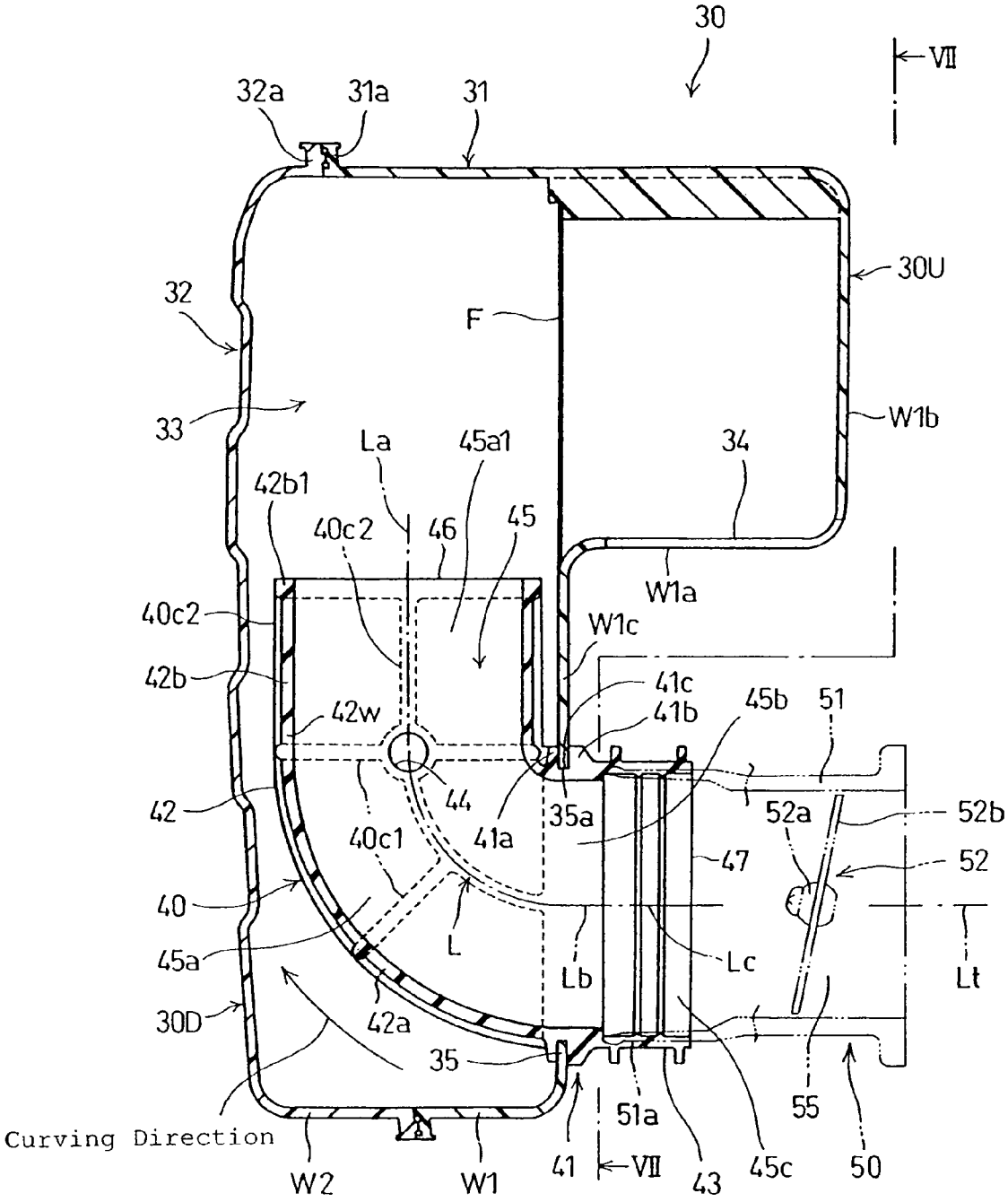
FIG. 6 is a sectional view taken on the line VI-VI in FIG. 3.
Figure 8:
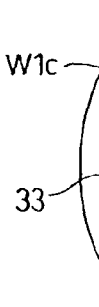
FIG. 8 is a sectional view taken on the line b-b in FIG. 7.

Referring to FIG. 6, the throttle device 50 has a throttle body 51 defining an intake passage 55 through which air from the air passage 45 flows, a throttle valve 52 disposed in the intake passage 55 to control the flow of intake air, and a throttle operating mechanism 53 (FIGS. 2 and 3) for operating the throttle valve 52 for opening and closing. The throttle valve 52 is a butterfly valve having a valve shaft 52*a* supported for turning on the throttle body 51, and a valve element 52*b* attached to the valve shaft 52*a*. The throttle operating mechanism 53 includes an operating lever 53*b* for operating an operating arm 53*a* fixed to the valve shaft 52*a*, and a return spring 53*c* urging the throttle valve 52 in a closing direction. The operator operates a throttle lever to open or close the throttle valve 52 by turning the operating lever 53*b* by the operating arm 53*a*. The opening of the throttle valve 52 detected by a throttle position sensor 54 is used for determining injection rate at which the fuel injection valve injects fuel.

Referring particularly to FIG. 6, the intake silencer 30 has a first unit 30U provided with the intake air inlet 34, and a second unit 30D provided with a connecting part 35 to which the connecting pipe 40 is connected, and containing an inner tubular part 42. The first unit 30U and the second unit 30D are separated from each other by a flame arrester F disposed in the expansion chamber 33 having the intake air inlet 34. The flame arrester F is a wire netting capable of preventing backfiring flames from reaching the intake air inlet 34.

The first unit 30U forms an upper part of the intake silencer 30 and is a protruding part. The throttle body 51 defining the intake passage 55 is disposed to protrude from the intake silencer 30 in the same direction as the first unit 30U. The first unit 30U is disposed in a space extending over the throttle body 51 protruding from the intake silencer 30. The first unit 30U defines a cylindrical space having an axis substantially parallel to the laterally extending center line Lt of the intake passage 55. An open end of the first unit 30U opening in the direction of the axis connects to the second unit 30D. The intake air inlet 34 of the first unit 30U is formed in a flat bottom wall W1*a* of the first unit 30U substantially parallel to the center line Lt of the intake passage 55. The bottom wall W1*a* of the first unit 30U has an inclined bottom surface W1*a*1 (FIG. 3) facing a little toward the front. The bottom wall W1*a* of the first unit 30U is opposite to the throttle body 51 with respect to a direction parallel to a diameter of the throttle body 51 and substantially parallel to the inlet 46. The intake air inlet 34 opens in the bottom surface W1*a*1 obliquely downward toward the front.

In the specification and the appended claims, the term "diametrical direction" signifies a direction parallel to a diameter of a circle having its center on the center line L of the air passage 45 or the center line Lt of the intake passage 55 and "circumferential direction" signifies a direction along the circumference of a circle having its center on the center line L or Lt. In this embodiment, center lines Lb and Lc and the center line Lt are substantially parallel to a lateral direction.

The case 31 of the second unit 30D formed by joining together the cases 31 and 32 is provided with the connecting part 35 to which the connecting pipe 40 of the intake silencer 30 is connected, and recessed parts 36 and 37 (FIGS. 2 and 5) for avoiding interference between the intake silencer 30 and the crankcase 21 and between the intake silencer 30 and the throttle operating mechanism 53.

The connecting part 35 in a lower part of the intake silencer 30 under the first unit 30U is connected to a circumferential edge part of a circular opening 35*a* formed in a substantially vertical, flat wall W1*c* (FIGS. 5 and 6) extending substantially perpendicularly to the lateral direction. The opening 35*a* and the connecting part 35 have center lines substantially aligned with the center line Lt of the intake passage 55, and the respective center lines Lb and Lc of air passages 45*b* and 45*c* formed in a connecting part 41 and an outer tubular part 43. The opening 35*a* and the connecting part 35 are substantially in a plane perpendicular to the center line Lb.

Figure 3:
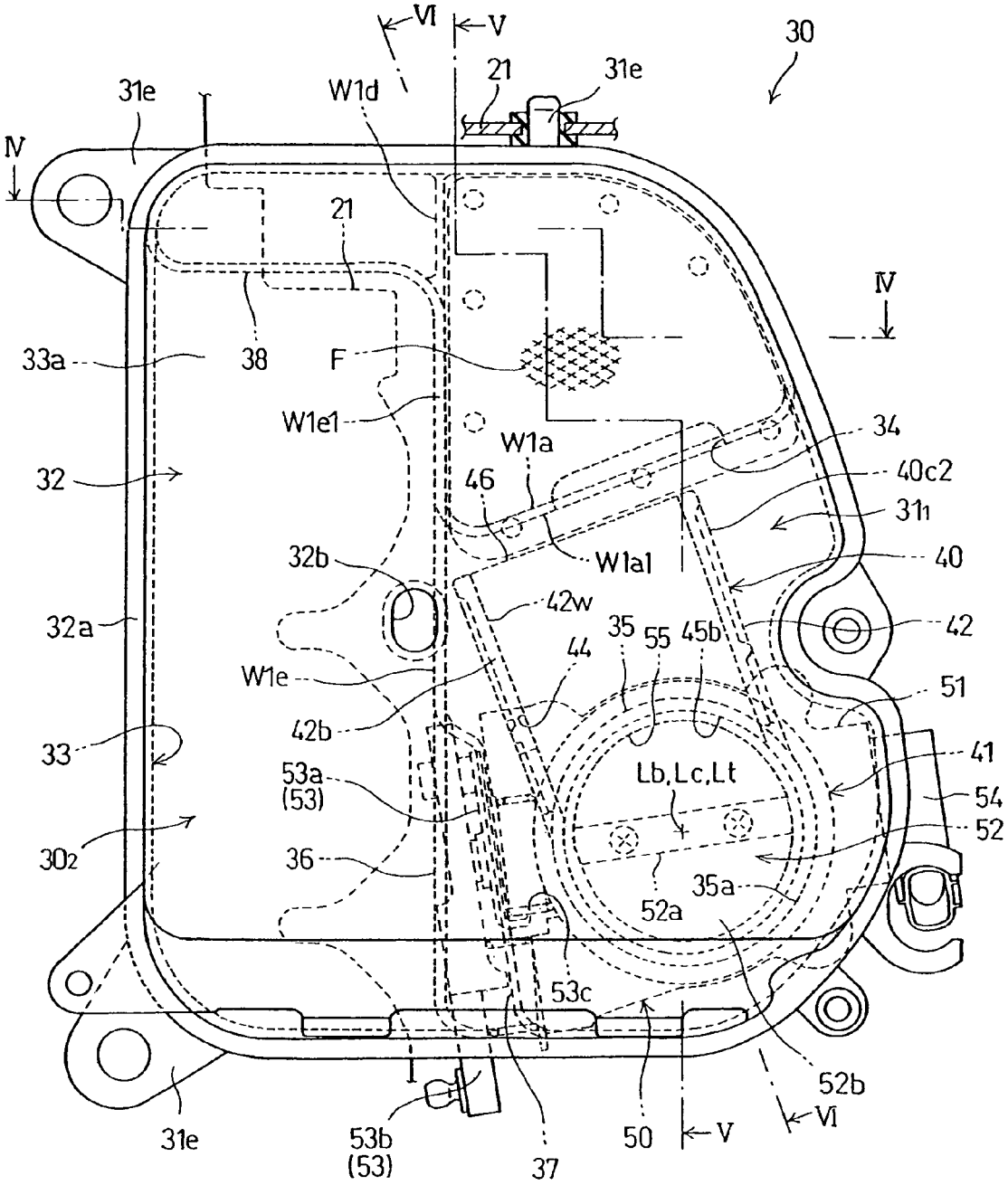
FIG. 3 is a right-hand side elevation taken in the direction of the arrow III in FIG. 2.
Figure 4:
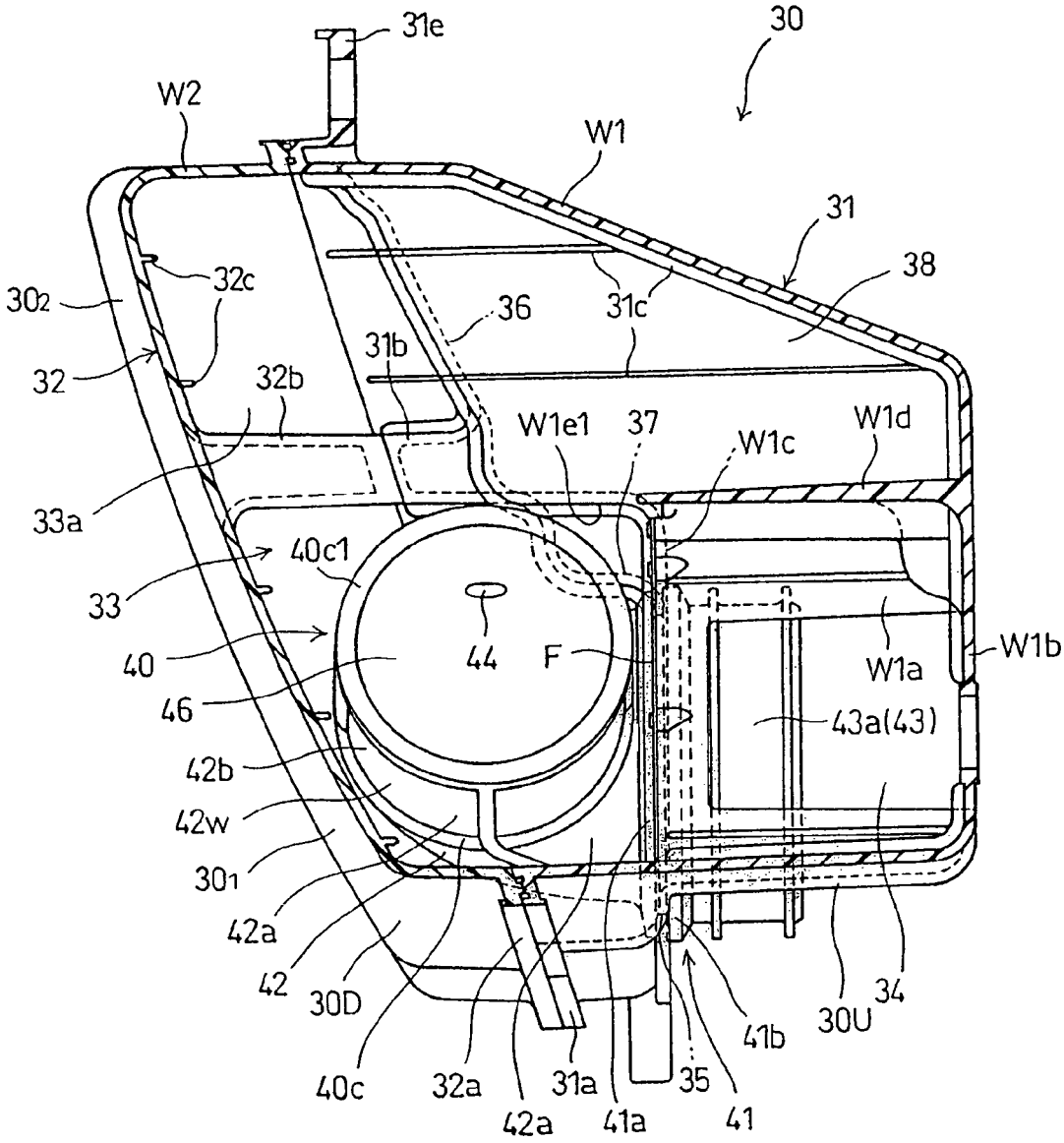
FIG. 4 is a sectional view taken on the line IV-IV in FIG. 3.
Figure 5:
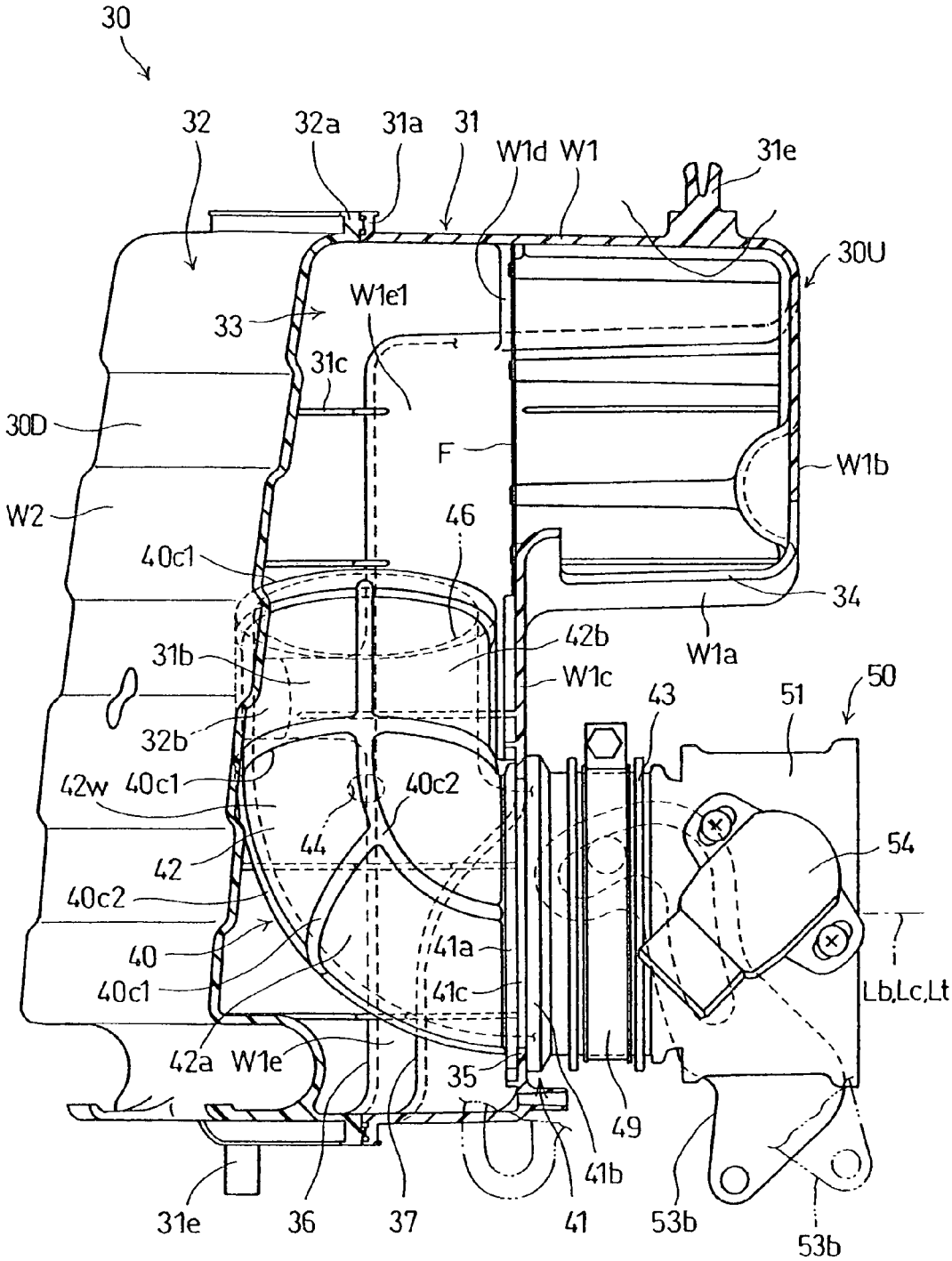
FIG. 5 is a sectional view taken on the line V-V in FIG. 3.
Figure 7:
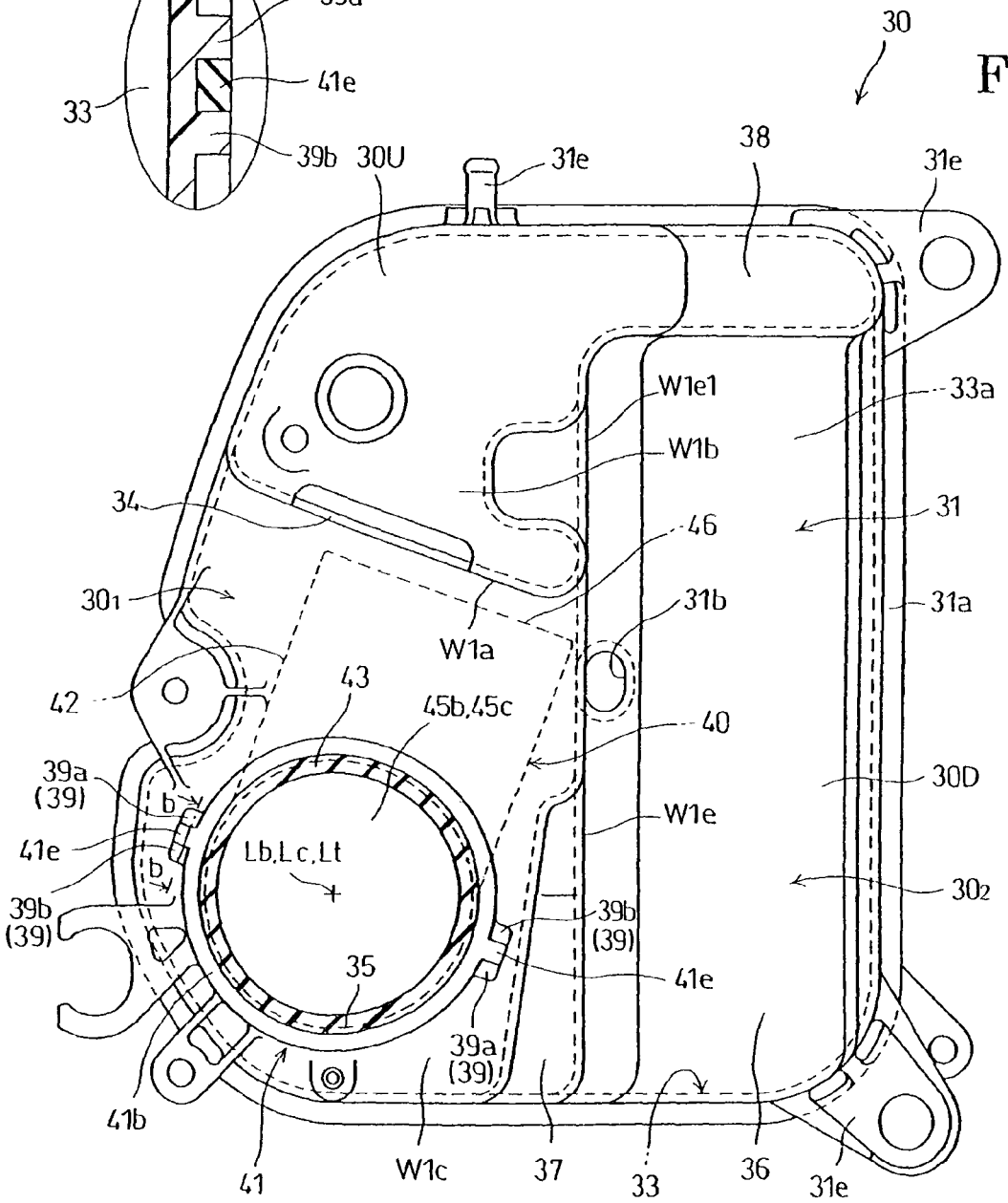
FIG. 7 is a sectional view taken on the line VII-VII in FIG. 6.

Referring to FIGS. 3, 4 and 7, the intake silencer 30 is divided into two regions 30, and 302 as viewed in a direction parallel to a direction in which the center lines Lb, Lc and Lt extend (hereinafter, referred to as "center line direction"). The region 30, contains the first unit 30U and the inner tubular part 42 having the connecting part 35. The region 302 contains the recessed parts 36 and 37 protruding into the expansion chamber 33, and a main chamber 33*a* occupying a major part of the volume of the expansion chamber 33. The recessed parts 36 and 37 extend substantially along a direction in which the first unit 30U and the connecting part 35 are arranged (hereinafter, referred to as "arranging direction", namely, a vertical direction in this embodiment). As best shown in FIG. 2, the recessed part 36 is provided to avoid interference between the intake silencer 30 and the crankcase 21, and the recessed part-37 is provided to avoid interference between the intake silencer 30 and the throttle arm. In FIG. 5, the throttle lever at a position for fully opening the throttle valve 52 is indicated by two-dot chain lines. A projection 38 (FIGS. 4 and 7) having the shape of an eave projects from the recessed part 36 in the region 302. The projection 38 is adjacent to the first unit 30U and is separated from the first unit 30U by a partition wall W1*d* (see also FIG. 5). The projection 38 increases the volume of the second unit 30D to enhance the silencing effect of the expansion chamber 33.

As shown in FIG. 5, a sunken wall W1*e* forming the recessed part 36 in the wall W1 extends substantially parallel to the arranging direction (substantially parallel to a plane perpendicular to the longitudinal direction in this embodiment) as viewed from the center line direction. The sunken wall W1*e* extends in the center line direction from the wall W1*c* to the substantially middle position between the inlet 46 and a straight part 42*b*. A guide wall W1*e*1 is a part of the sunken wall W1*e*. The guide wall W1*e*1 is a part of the sunken wall W1*e* extending in the arranging direction beyond the inlet 46 and the intake air inlet 34. The guide wall W1*e*1 on the upstream side of the inlet 46 guides air taken in through the intake air inlet 34 so as to flow along the recessed parts 36 and 37 toward the inlet 46.

Referring to FIG. 6, the connecting pipe 40 having the shape of a round pipe is formed of an elastic material having rubber elasticity, such as a synthetic rubber. The connecting pipe 40 connects the intake silencer 30 to the throttle device 50 and forms the air passage 45 through which air flows from the expansion chamber 33 into the intake passage 55. The connecting pipe 40 includes the connecting part 41 inserted into an opening 35*a* of the connecting part 35, the inner tubular part 42 extending from the connecting part 41 into the expansion chamber 33, and the outer tubular part 43 extending to the outside of the expansion chamber 33 from the connecting part 41. An upstream end part 51*a* of the throttle body 51 is fitted in a downstream end part 43*a* (FIG. 4) of the outer tubular part 43 connected to the throttle device 50. The downstream end part 43*a* is fastened to the upstream end part 51*a* by a clamp 49 (FIG. 5), namely, a fastener, to connect the connecting pipe 40 to the throttle body 51. The connecting pipe 40 is provided on its outside surface with circumferential ribs 40*c*1, and ribs 40*c*2 extending along the center line L. The downstream end part 43*a* defines the outlet 47 of the air passage 45. Air flows from the outlet 47 through the intake passage 55 and the intake manifold 60 toward the combustion chambers 27.

The connecting pipe 40, the throttle body 51 and the intake manifold 60 form the intake passage of the intake system K. The air passage 45 and the intake passage 55 are sections of the intake passage.

The connecting part 41 fitted in the connecting part 35 is provided on its outside surface with a pair of annular inner and outer flanges 41*a* and 41*b* defining an annular groove 41*c* (FIG. 6), and a pair of positioning protrusions 41*e* (FIG. 7) for determining the circumferential position of the connecting part 41 relative to the intake silencer 30. The connecting part 35 is fitted in the annular groove 41*c*. The inner flange 41*a* and the outer flange 41*b* are formed outside and inside the expansion chamber 33, respectively.

The positioning protrusions 41*e* protrude diametrically outward from diametrically opposite positions, respectively, on the outer flange 41*b*. A pair of positioning recesses 39 is formed on the intake silencer 30. The positioning protrusions 41*e* engage in the positioning recesses 39, respectively. Each of the positioning recesses 39 is defined by protrusions 39*a* and 39*b* protruding from the outside surfaces of the walls W1 and W2. The positioning recesses 39 open in a direction in which the connecting pipe 40 is inserted into the opening 35*a* when the connecting pipe 40 is connected to the intake silencer 30.

When the positioning protrusions 41*e* are engaged in the positioning recesses 39, the connecting part 41 is set at a predetermined circumferential position with respect to a curving direction, which will be described later, relative to the intake silencer 30, and the connecting pipe 40 is restrained from turning in circumferential directions relative to the intake silencer 30. The positioning protrusions 41*e* and the positioning recesses 39 serve also as a connecting pipe detaining structure.

As shown in FIG. 6, the inner tubular part 42 curves in the second unit 30D from the connecting part 41 so that the inlet 46 approaches the intake air inlet 34. The inner tubular part 42 has a curved part 42*a* curving from the connecting part 41 toward the intake air inlet 34 substantially through 90°, and the straight part 42*b* extending substantially parallel to the wall W1 from the upper end of the curved part 42*a*. The wall 42*w* of the inner tubular part 42 isolates the air passage 45 from the expansion chamber 33 of the intake silencer 30. The wall 42*w* is provided with a communication opening 44 for connecting the expansion chamber 33 and the air passage 45 to make the expansion chamber 33 serve also as a resonance chamber. The inlet 46 is defined by an upstream end part 42*b*1 of the straight part 42*b*.

The inlet 46 and the intake air inlet 34 are arranged in a direction in which the inner tubular part 42 is curved as shown in FIG. 4 and open in substantially parallel planes, respectively. The inlet 46 and the intake air inlet 34 are close to each other with respect to a direction in which the center line La of an air passage 45*a*1 in the air passage 45 in the straight part 42*b* extends or in a direction in which air flows through the inlet 46. Therefore, the pulsation generated in the intake passage 55 is transmitted to the upstream side by being curving once by the curved part 42*a* of the connecting pipe 40, changing the direction in the area between the inlet 46 and the first unit 30U, and is curved once toward the intake air inlet 34 in the first unit 30U. Thus the pulsation is curved or changed in direction at least three times between the air passage 45 and the intake air inlet 34. Consequently, intake noise radiated through the intake air inlet 34 is reduced.

The opening 44 opens into the main chamber 33*a*. The opening 44 is formed at a position on the side of the intake air inlet 34 with respect to the center line Lb of the air passage 45*b* in the connecting part 41. In this embodiment, the opening 44 is nearer to the intake air inlet 34 than the air passage 45*b*. The curved part 42*a* is curved such that the opening 44 is near the central part of the expansion chamber 33 relative to the connecting part 41. The air passage 45*c* is the exit of the intake silencer 30 because air flows from the expansion chamber 33 to the outside of the intake silencer 30 through the air passage 45*c*.

The opening 44 is formed in a thick part of the connecting pipe 40 corresponding to the thick intersection of the rib 40*c*1 and 40*c*2. Therefore, the strength of the connecting pipe 40 will not be reduced by the formation of the opening 44 even though the connecting pipe 40 is made of an elastic material. The opening 44 enables the intake silencer 30 having the expansion chamber 30 serving also as a resonance chamber to exercise a combined silencing effect of an expansion silencer and a resonance silencer. In the embodiment described herein, the position of the opening 44 is near the boundary between the curved part 42*a* and the straight part 42*b*.

The length of the outer tubular part 43 or the length of a passage defined by the outer tubular part 43 is shorter than the length of the inner tubular part 42 or the length of a passage defined by the inner tubular part 42. Therefore, the throttle body 51 can be disposed close to the intake silencer 30. The length of the air passage 45*a* in the inner tubular part 42 is determined such that a node in a wave representing pulsating intake air that generates intake noise coincides with the inlet 46 or a position near the inlet 46. The length of a pipe or that of a passage defined by a pipe is measured along the center line of the pipe or the passage defined by the pipe.

The connecting part 41 and the outer tubular part 43 are continuous with the straight part 42*b*, and the center lines Lb and Lc are aligned with the centerline Lt. Therefore, even if the intake silencer 30 is not provided with the detaining structure including the positioning protrusions 41*e* and the positioning recesses 39, and the connecting pipe 40 is turned relative to the connecting part 35 of the intake silencer 30 to change the curving direction of the connecting pipe 40 relative to the intake silencer 30, the position of the throttle body 51 relative to the connecting pipe remains unchanged. Thus the circumferential position of the connecting pipe 40 on the connecting part relative to the intake silencer 30 can be changed without changing the position of the throttle body 51 relative to the intake silencer 30. The curving direction can be adjusted so that the utmost silencing effect can be achieved by adjusting the position of the inlet 46 in the expansion chamber 33.

When the connecting pipe 40 is connected to the intake silencer 30, the straight part 42*b* is compressed to reduce the diameter thereof slightly, the straight part 42*b* is inserted through the opening 35*a* into the expansion chamber 33 so that the connecting part 35 is fitted in the annular groove 41*c*. Upon the completion of connection, the connecting part 41 engaged with the connecting part 35 is slightly elastically deformed. To remove the connecting pipe 40 from the intake silencer 30, the connecting part 41 is deformed so as to reduce the diameter thereof to disengage the connecting part 41 from the connecting part 35, and then the connecting part 41 and the inner tubular part 42 are pulled off the opening 35*a*. Thus the connecting part 41 can be detachably connected to the connecting part 35 of the intake silencer 30.

The operation and effect of the foregoing embodiment will be described.

In the intake system K, the connecting pipe 40 has the wall 42*w* isolating the air passage 45 from the expansion chamber 33 of the intake silencer 30, the wall 42*w* defines the inlet 46, and the wall 42*w* is provided with the communication opening 44 by means of which the expansion chamber 33 communicates with the air passage 45 to make the expansion chamber 33 function also as a resonance chamber. Since the communication opening 44 enables the expansion chamber 33 to function also as a resonance chamber, the intake silencer 30 dos not need to be additionally provided with a resonance chamber. The combined effect of expansion silencing and resonance silencing improves the intake noise silencing effect. Thus the intake silencer 30 provided with the expansion chamber 33 can exercise a resonance silencing effect. The intake silencer 30 is compact and a high intake noise silencing effect.

In the intake system K, the connecting pipe 40 connecting the intake silencer 30 with the throttle body 51 is made of an elastic material having rubber elasticity. The connecting pipe 40 has a connecting part 41 fitted in the connecting part 35 of the intake silencer 30, an inner tubular part extending from the connecting part 41 into the expansion chamber 33, and an outer tubular part extending from the connecting part 41 to the outside of the expansion chamber 33. The length of the outer part 43 connected with the throttle body 51 is shorter than that of the inner tubular part 42. The connecting pipe 40 made of an elastic material having rubber elasticity suppresses the transmission of vibrations of the engine body through the throttle device 50 to the intake silencer and, consequently, the vibration of the intake silencer 30 can be reduced. Since the outer tubular part 43 has a length shorter than that of the inner tubular part 42, the intake silencer 30 and the throttle device 50 can be disposed close to each other, the space between the intake silencer 30 and the throttle device 50 can be narrowed, the inner tubular part 42 extending in the intake silencer 30 can be formed in a long length and hence the enlargement of the intake system K due to forming the intake passage in a long length can be avoided. Consequently, noise generated by the vibration of the intake silencer 30 is reduced, the intake silencer 30 and the throttle device 50 can be disposed in compact arrangement, the enlargement of the intake system K can be avoided, and the intake silencer 30 can meet demand for increasing engine output and the reduction of intake noises of frequencies in various frequency ranges by properly adjusting the length of the inner tubular part 42 extending in the intake silencer 30.

The connecting pipe 40 has the connecting part 41 connected to the intake silencer 30, and the inner tubular part 42 extending in the expansion chamber 33. The inner tubular part 42 has the curved part 42*a* curved relative to the connecting part 41 such that the opening 44 approaches the central part of the expansion chamber 33. Since the inner tubular part 42 is curved in the expansion chamber 33, the length of the inner tubular part 42 extending in the expansion chamber 33 can be increased without affecting the compactness of the intake silencer 30. The intake silencer 30 can meet demand for silencing intake noises of frequencies in various frequency ranges by properly adjusting the length of the inner tubular part 42. Since the opening 44 can be positioned near the central part of the expansion chamber 33 by curving the inner tubular part 42, the expansion chamber 33 can be effectively used as a resonance chamber regardless of the position of the air passage 45*b* in the connecting part 41 at the exit of the intake silencer in the intake silencer 30. Therefore, the degree of freedom of adjusting the length of the inner tubular part 42 extending in the expansion chamber 33 increases, the intake silencer 30 can be formed in compact construction, and the intake system K can meet demand for suppressing intake noises of frequencies in various frequency ranges. Since the opening 44 can be disposed near the central part of the expansion chamber 33 by curving the inner tubular part 42 of the connecting pipe 40, the silencing effect can be enhanced without forming the intake silencer 30 in complicated construction.

Since the curved part 42*a* is curved through about 90° relative to the connecting part 41, the intake noise enters the expansion chamber 33 after impinging on the curved part 42*a*. Thus the curved part 42*a* increases the frequency of changes of the flowing direction of the pulsating intake air and the intake noise radiated from the intake air inlet 34 can be reduced accordingly. Since the frequency of changes of the flowing direction of the pulsating intake air can be increased by using the inner tubular part 42, the silencing effect can be enhanced without complicating the shape of the intake silencer 30.

In the intake system K, the connecting pipe 40 connecting the intake silencer 30 and the throttle body 51 is made of the elastic material having rubber elasticity, and has the connecting part 41 fitted in the connecting part 35 of the intake silencer 30, the inner tubular part 42 extending from the connecting part 41 into the expansion chamber 33, and the outer tubular part 43 extending from the connecting part 41 to the outside of the expansion chamber 33. The length of the outer tubular part 43 connected to the throttle body 51 is shorter than that of the inner tubular part 42. Therefore, the transmission of vibrations of the engine body through the throttle device 50 to the intake silencer 30 can be suppressed by the connecting pipe 40 made of the elastic material having rubber elasticity and, consequently, the vibration of the intake silencer 30 can be reduced. Since the outer tubular part 43 of the connecting pipe 40 is shorter than the inner tubular part 42 of the connecting pipe 40, the intake silencer 30 and the throttle device 50 can be disposed close to each other, and the space between the intake silencer 30 and the throttle device 50 can be narrowed. The inner tubular part 42 extending in the intake silencer 30 can be formed in a long length. Thus the enlargement of the intake system K can be avoided. Noise generated by the vibration of the intake silencer 30 can be reduced, the intake silencer 30 and the throttle device 50 can be disposed in compact arrangement, the enlargement of the intake system K can be avoided, and the intake silencer 30 can meet demand for increasing engine output and the reduction of intake noises of frequencies in various frequency ranges by properly adjusting the length of the inner tubular part 42 extending in the intake silencer 30.

The inner tubular part 42 is curved toward the intake air inlet 34, and the inlet 46 of the air passage 45 and the intake air inlet 34 are arranged in the direction in which the inner tubular part 42 is curved. The passage length of the compact intake silencer 30 provided with the curved inner tubular part 42 is long as compared with that of the intake silencer 30 when the intake silencer 30 is provided with a straight inner tubular part. Since the inlet 46 and the intake air inlet 34 are arrange in the direction in which the inner tubular part 42 is curved, air can flow in a comparatively simple flow from the intake air inlet to the inlet 46, and the intake silencer 30 exerts a low passage resistance on the flow of air. Therefore, the degree of freedom of adjusting the length of the inner tubular part 42 to meet demand for increasing engine output and reducing intake noise while the intake silencer 30 is formed in compact construction, and intake efficiency can be improved.

The connecting part 41 is provided on its outside surface with the inner flanges 41*a* and the outer flange 41*b* defining the annular groove 41*c*, and the positioning protrusions 41*e* are formed on the axially outer annular flange 41*b* to determine the circumferential position of the connecting part 41 relative to the intake silencer 30. Any fastening means, such as a clamp, for fastening the connecting pipe 40 to the intake silencer 30 is not necessary, which reduces the cost. The inner part 42 can be readily positioned relative to the intake silencer 30 by using the outer flange 41*b* forming the annular groove 41*c* so as to curve in an optimum direction for suppressing intake noise. The intake noise suppressing effect can be optimized by thus determining the curving direction of the connecting pipe 40 in the intake silencer 30.

The first unit 30U is disposed in a space needed for disposing the throttle body 51 connected to the intake silencer 30, and the expansion chamber 33 having a large volume can be formed by utilizing the space between the intake silencer 30 and the throttle device 50. Thus the silencing effect can be enhanced, while the intake silencer 30 and the throttle device 50 are disposed in a compact arrangement.

Since the intake silencer 30 has the recessed parts 36 and 37, the intake silencer 30 can be disposed close to the engine body and the throttle operating mechanism 53. Thus the intake silencer 30 can be disposed in a small space in the outboard motor S.

The guide wall W1*e*1, which is a part of the sunken wall W1*e*, guides air taken in through the intake air inlet 34 toward the inlet 46. Since the flow of air taken in through the intake air inlet 34 is deflected toward the inlet 46, intake efficiency can be improved.

Possible modifications of the foregoing embodiment will be described.

The throttle device may be a carburetor provided with a throttle valve, namely, an air-fuel mixture supply means.

The positioning protrusions 41*e* do not need to serve also as the connecting pipe detaining members and may have only a positioning function for determining the curving direction of the inner tubular part 42. When the connecting pipe detaining members are unnecessary, a mark and a line may be used in combination instead of the positioning protrusions 41*e* to indicate a desired circumferential position of the connecting part 41 for the adjustment of the curving direction.

The positioning protrusions 41*e* may be formed on the inner flange 41*a*.

A connecting pipe formed by assembling a plurality of members may be used instead of the integrally formed connecting pipe 40. Part of the air passage may be formed by walls.

When the connecting pipe 40 is not made of an elastic material, at least the inner tubular part 42 may be formed integrally with the intake silencer 30. In such a case, a part of the air passage may be formed by the walls.

A connecting pipe having at least two curved parts may be combined with the intake silencer to change the flowing direction of the intake air at least twice between the air passage and the intake air inlet and at least three times in the expansion chamber before the intake air reaches the intake air inlet.

The internal combustion engine may be incorporated into marine propulsion machines other than the outboard motor or may be incorporated into machines other than marine propulsion machines, such as vehicles.

The invention claimed is:

1. An internal combustion engine comprising an intake system including an intake silencer provided with an expansion chamber having an intake air inlet for conducting air into the expansion chamber; and an air passage structure disposed within the expansion chamber forming an air passage and having:

a passage wall isolating the air passage from the expansion chamber, an open air inlet end through which air from the expansion chamber flows into the air passage structure, an air outlet end through which air from the air passage structure flows out of the expansion chamber toward combustion chambers, and a communication opening between the air passage and the expansion chamber disposed on the passage wall;

wherein the communication opening allows the expansion chamber to communicate with the air passage such that the expansion chamber additionally functions as a resonance chamber.

2. The internal combustion engine according to claim 1, wherein the passage structure further includes a connecting part connecting the air outlet end to the intake silencer, and wherein the passage wall is provided by an inner tubular part extending within the expansion chamber between the air intake end and the air outlet end of the passage structure.

3. The internal combustion engine according to claim 2, wherein the inner tubular part has a curved part curving from the connecting part toward a central region of the expansion chamber.

4. The internal combustion engine according to claim 3, wherein the curved part is curved through an angle of about 90° relative to the connecting part.

5. The internal combustion engine according to claim 3, wherein the passage structure has a straight part extending from an end of the curved part remote from the connecting part, and the open air inlet end is formed in a free end of the straight part.

6. The internal combustion engine according to claim 5, wherein the communication opening is formed in the vicinity of a joint of the curved part and the straight part.

7. The internal combustion engine according to claim 1, wherein the expansion chamber forces a redirection of the air flow from the intake air inlet of the intake silencer toward the open air inlet end of the air passage.

8. The internal combustion engine according to claim 2, wherein the passage structure has an outer tubular part extending to outside of the expansion chamber from the connecting part and connecting to a throttle device having a throttle body forming an intake passage in which a throttle valve is placed, and the passage structure is made of an elastic material having rubber elasticity.

9. The internal combustion engine according to claim 8, wherein the outer tubular part is shorter than the inner tubular part.

10. The internal combustion engine according to claim 3, wherein the open air inlet end of the passage structure, and the intake air inlet are arranged in a direction in which the curved part of the inner tubular part of the connecting pipe is curved.

11. The internal combustion engine according to claim 3, wherein the connecting part is provided with positioning means for determining a circumferential position of the connecting part relative to the intake silencer to determine a direction in which the inner tubular part is curved relative to the intake silencer.

12. The internal combustion engine according to claim 1, wherein the open air inlet end of the air passage structure and the intake air inlet for conducting air in to the expansion chamber are arranged in side-by-side positions and respectively open in substantially parallel planes such that a direction in which air flows from the expansion chamber into the open air inlet end is substantially opposite to a direction in which air is conducted into the intake air inlet, whereby air conducted through the intake air inlet into the expansion chamber is caused to change in flow direction toward the open air inlet end within the expansion chamber.

13. An internal combustion engine comprising:

an intake system having an intake silencer with an expansion chamber formed therein; and an air passage structure forming an air passage and having:

a passage wall isolating the air passage from the expansion chamber, a first portion disposed within the expansion chamber with an open air inlet end through which air from the expansion chamber flows into the air passage structure, a second portion extending out of the expansion chamber toward a throttle body with an air outlet end through which air from the air passage structure flows out of the expansion chamber toward combustion chambers, and a communication opening between the air passage and the expansion chamber disposed on the passage wall along the first portion;

wherein the communication opening allows the expansion chamber to communicate with the air passage such that the expansion chamber additionally functions as a resonance chamber.

14. The internal combustion engine according to claim 13, wherein the passage wall is formed in a substantially cylindrical configuration.

15. The internal combustion engine according to claim 13, wherein the first portion of the air passage structure is formed in a substantially curved manner and includes a terminal portion that is substantially perpendicular to the second portion of the air passage structure.

16. The internal combustion engine according to claim 13, wherein the air passage structure is configured with an annular flange having a groove formed therein to receive a wall portion of said expansion chamber therein.

17. The internal combustion engine according to claim 13, wherein the first portion of the air passage structure is greater in length than the second portion.

18. An intake system for an engine, said intake system comprising:

an intake silencer having an expansion chamber formed therein; and an air passage structure disposed within the expansion chamber forming an air passage and having:

a passage wall isolating the air passage from the expansion chamber, an open air inlet end through which air from the expansion chamber flows into the air passage structure, an air outlet end through which air from the air passage structure flows out of the expansion chamber toward combustion chambers, and a communication opening between the air passage and the expansion chamber disposed on the passage wall;

wherein the communication opening allows the expansion chamber to communicate with the air passage such that the expansion chamber additionally functions as a resonance chamber.

19. The intake system for an engine according to claim 18, wherein the passage structure further includes a connecting part connecting the air outlet end to the intake silencer, and wherein the passage wall is provided by an inner tubular part extending within the expansion chamber between the air intake end and the air outlet end of the passage structure.

20. The intake system for an engine according to claim 19, wherein:

the inner tubular part has a curved part curving from the connecting part toward a central region of the expansion chamber;

the passage structure has a straight part extending from an end of the curved part remote from the connecting part, and the air inlet is formed in a free end of the straight part; and the communication opening is formed in the vicinity of a joint of the curved part and the straight part.

* * * * *